US009013317B2

(12) United States Patent
Brigham et al.

(10) Patent No.: US 9,013,317 B2
(45) Date of Patent: Apr. 21, 2015

(54) OPTICAL SMOKE DETECTOR

(75) Inventors: Peter Brigham, Coventry (GB); Stuart Hart, Coventry (GB)

(73) Assignee: Sprue Safety Products Ltd., London (GB)

( * ) Notice: Subject to any disclaimer, the term of this patent is extended or adjusted under 35 U.S.C. 154(b) by 0 days.

(21) Appl. No.: 13/642,311

(22) PCT Filed: Apr. 20, 2011

(86) PCT No.: PCT/GB2011/000611
§ 371 (c)(1),
(2), (4) Date: Dec. 11, 2012

(87) PCT Pub. No.: WO2011/131935
PCT Pub. Date: Oct. 27, 2011

(65) Prior Publication Data

US 2013/0201022 A1 Aug. 8, 2013

(30) Foreign Application Priority Data

Apr. 21, 2010 (GB) ..... 1006682.7

(51) Int. Cl.
*G08B 17/10* (2006.01)
*G08B 17/06* (2006.01)
(Continued)

(52) U.S. Cl.
CPC ..... *G08B 17/06* (2013.01); *G08B 17/107* (2013.01); *G08B 29/183* (2013.01); *G08B 29/24* (2013.01)

(58) Field of Classification Search
USPC ..... 340/628, 630, 584
See application file for complete search history.

(56) References Cited

U.S. PATENT DOCUMENTS 4,266,220 A * 5/1981 Malinowski ..... 340/630
5,530,433 A * 6/1996 Morita ..... 340/630
(Continued)

FOREIGN PATENT DOCUMENTS

EP 0618555 10/1994
EP 1732049 12/2006
(Continued)

OTHER PUBLICATIONS

International Search Report and Written Opinion dated Jul. 28, 2011 corresponding to International Patent Application No. PCT/GB2011/000611.
(Continued)

*Primary Examiner* — Eric M Blount
(74) *Attorney, Agent, or Firm* — Ohlandt, Greeley, Ruggiero & Perle, LLP

(57) ABSTRACT

An optical smoke detector (110) is provided that comprises a housing (112) having a base (114) for attaching the detector to a surface and a cover (116) having a side wall (124) and a bottom wall (126) defining the interior of said cover. An optical sensor (131) is provided for generating a signal representative of the detected light and a control circuit (130) is provided for controlling operation of the detector. The control circuit (130) includes a plurality of temperature sensors (D1, D2) for sensing a rise in ambient temperature and generating a signal representative thereof. The temperature sensors (D1, D2) are located above an internal surface of said bottom wall (126) within the housing and are substantially equally spaced. The control circuit (30) is operable to compare said representative signal with a reference signal and generate an alarm signal in dependence thereon.

17 Claims, 6 Drawing Sheets

(51) Int. Cl.

| | |
|---|---|
| ***G08B 17/107*** | (2006.01) |
| ***G08B 29/18*** | (2006.01) |
| ***G08B 29/24*** | (2006.01) |

(56) References Cited

U.S. PATENT DOCUMENTS

| | | | | |
|---|---|---|---|---|
| 5,592,147 | A * | 1/1997 | Wong | 340/522 |
| 5,721,529 | A * | 2/1998 | Vane et al. | 340/515 |
| 5,945,924 | A | 8/1999 | Marman | |
| 6,060,991 | A * | 5/2000 | Hsieh | 340/632 |
| 6,084,522 | A | 7/2000 | Addy | |
| 6,788,197 | B1 | 9/2004 | Thuillard et al. | |
| 6,967,582 | B2 * | 11/2005 | Tice et al. | 340/630 |
| 2008/0018485 | A1 * | 1/2008 | Kadwell et al. | 340/630 |
| 2010/0073172 | A1 | 3/2010 | Lax | |

FOREIGN PATENT DOCUMENTS

| | | | |
|---|---|---|---|
| GB | 2305760 | A | 4/1997 |
| GB | 2306218 | A | 4/1997 |
| GB | 2369437 | A | 5/2002 |
| JP | H06288917 | A | 10/1994 |
| JP | H0991559 | A | 4/1997 |
| JP | H11312286 | A | 11/1999 |
| WO | 2008/011413 | | 1/2008 |

OTHER PUBLICATIONS

International Search Report dated Aug. 10, 2010 for Great Britain application No. GB1006682.7.

Japanese Office Action dated Oct. 14, 2014 for Japanese application No. 2013-505529.

* cited by examiner

Slow Smouldering Fire

Sast Flaming Fire

OPTICAL SMOKE DETECTOR

BACKGROUND OF THE DISCLOSURE

1. Field of the Disclosure

The present invention relates to optical fire/smoke detectors.

2. Description of the Related Art

Fires can occur in a variety of ways. The two most common forms of fires are slow smouldering fires and fast flaming fires.

A smouldering fire is a slow, low-temperature, flameless form of combustion. These fires develop slowly and generate a significant amount of smoke which is easily detected by an optical smoke detector. Smouldering fires are typically initiated on upholstered furniture by weak heat sources such as cigarettes or an electrical short-circuit.

Fast flaming fires develop rapidly, typically generating black smoke and toxic fumes and leave little time for escape.

The characteristic temperature and heat released during smouldering (typically 600° C.) are low compared to those in a fast flaming fire (typically 1500° C.). Fast flaming fires propagate typically about ten times faster than smouldering fires. However, smouldering fires emit a high level of toxic gases such as carbon monoxide. These gases are highly inflammable and could later be ignited in the gas phase, triggering the transition to flaming combustion.

Both optical smoke alarms which use an infra-red emitter LED and ionisation type smoke alarms are used in the detection of both types of fires.

Optical type smoke alarms have an operational disadvantage when compared with ionisation type smoke alarms. They are relatively insensitive to black smoke created during fast-flaming fires. The optical method of smoke detection relies on light reflected off smoke as it enters the smoke alarm chamber. Black smoke absorbs light, rendering itself nearly invisible under optical sensing conditions. As a result, there is a significant time delay before the optical alarm is activated. Ionisation type alarms don't suffer from the same reliance on reflected light and therefore usually respond to fast flaming fires more quickly than optical type alarms, typically more than twice as fast.

However, ionisation alarms have the disadvantage that, as they contain radioactive isotopes in their sensors they are subject to regulations concerning their manufacture and disposal. These regulations depend upon the country but can place a considerable burden on the manufacturer.

The present invention seeks to provide an improved optical smoke alarm.

SUMMARY OF THE DISCLOSURE

Accordingly, the present invention provides an optical smoke alarm comprising: a housing having a base for attaching the detector to a surface and a generally cup-shaped cover having a side wall and a bottom wall defining the interior of said cover; an optical sensor for generating a signal representative of the detected light; and a control circuit for controlling operation of the detector; wherein: said control circuit includes a plurality of temperature sensing means for sensing a rise in ambient temperature and generating a signal representative thereof; said temperature sensing means are located above said internal surface of said bottom wall within the housing and are substantially equally spaced; and said control circuit is operable to compare said representative signal with a reference signal and generate an alarm signal in dependence thereon.

The reference signal does not need to be directly or indirectly measured, it may, for example be a predetermined signal level stored in the control circuit to which the representative signal is compared.

Preferably comparing said representative signal with a reference signal and generating an alarm signal in dependence thereon further comprises the control circuit being configured to receive a signal from the optical sensor, compare the received signal from the optical sensor to an optical signal threshold and to only generate an alarm signal if the signal from the optical sensor falls outside said threshold.

The control circuit may be configured to adjust the sensitivity of the optical sensor in dependence on the comparison of said representative signal with said reference signal. Preferably adjusting the sensitivity of the optical sensor comprises lowering the threshold at which smoke is detected.

Preferably the temperature sensing means is fully enclosed within the main body of the smoke detector housing. In this way unsightly projections of the housing commonly used to house temperature sensors are avoided. By the use of two or more substantially equally spaced thermal sensors the risk of a retarded thermal sensing due to the sensor being sheltered from the heat, for example by the alarm circuitry, is much reduced and a more reliable alarm is achieved In a preferred embodiment of the invention said temperature sensing means is located above a boundary formed by a major portion of said bottom wall. The base 14 preferably has a side wall with a plurality of openings for the ingress of hot air, smoke and the like and said temperature sensing means is located in the path of said hot air passing through said openings.

Ideally, said temperature sensing means is located substantially on the same level as said openings.

In a further preferred embodiment of the invention said control circuit is operable to adjust the sensitivity of said sensor in dependence on the comparison of said representative signal with said reference signal thereby to generate said alarm signal.

Preferably said temperature sensing means is a device having an electrical property which changes with temperature change.

Said temperature sensing means may be a semiconductor device having a voltage or current characteristic which varies with temperature, and preferably substantially linearly with temperature over a major portion of its range.

In one embodiment said temperature sensing means is a diode whose forward bias voltage varies with temperature and in another embodiment said temperature sensing means is at least two series connected diodes whose forward bias voltage varies with temperature.

BRIEF DESCRIPTION OF THE DRAWINGS

The present invention is further described hereinafter, by way of example, with reference to the accompanying drawings, in which.

DESCRIPTION OF THE EMBODIMENT

Figure 1:
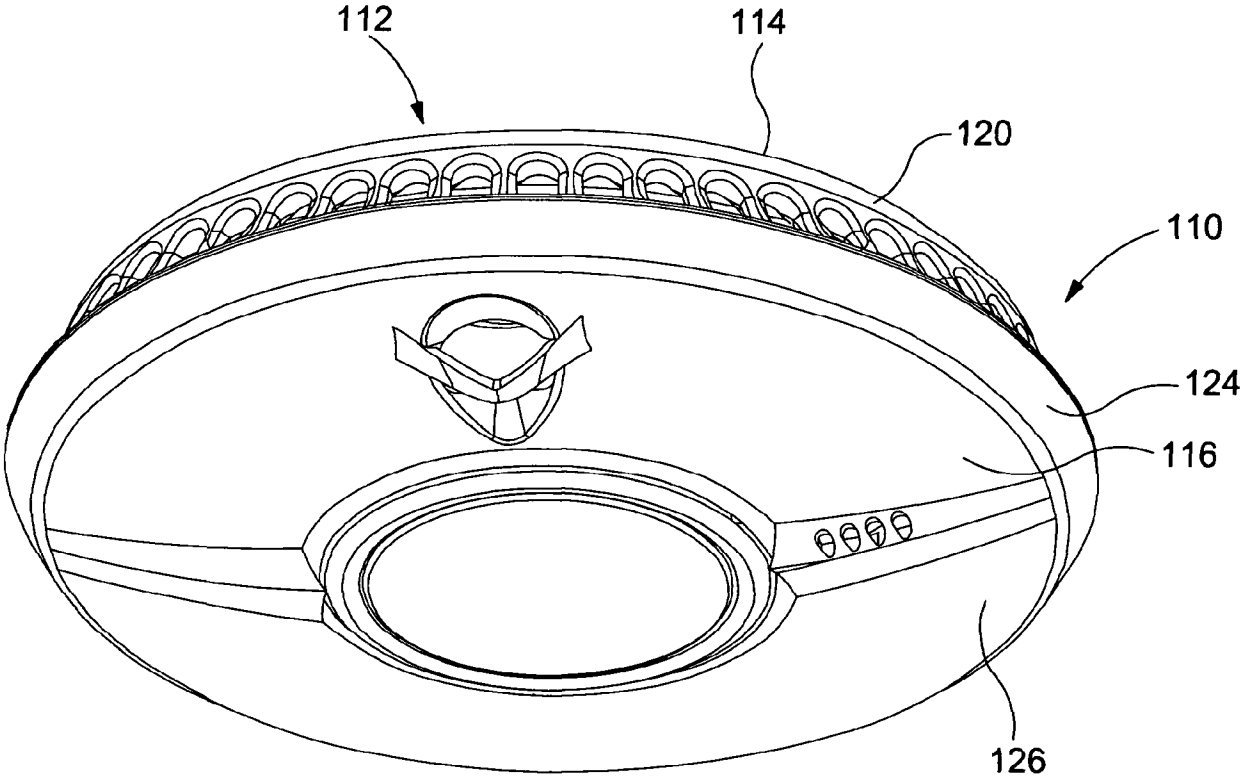
FIG. 1 is a perspective view from below of a preferred form of alarm according to the present invention.
Figure 2:
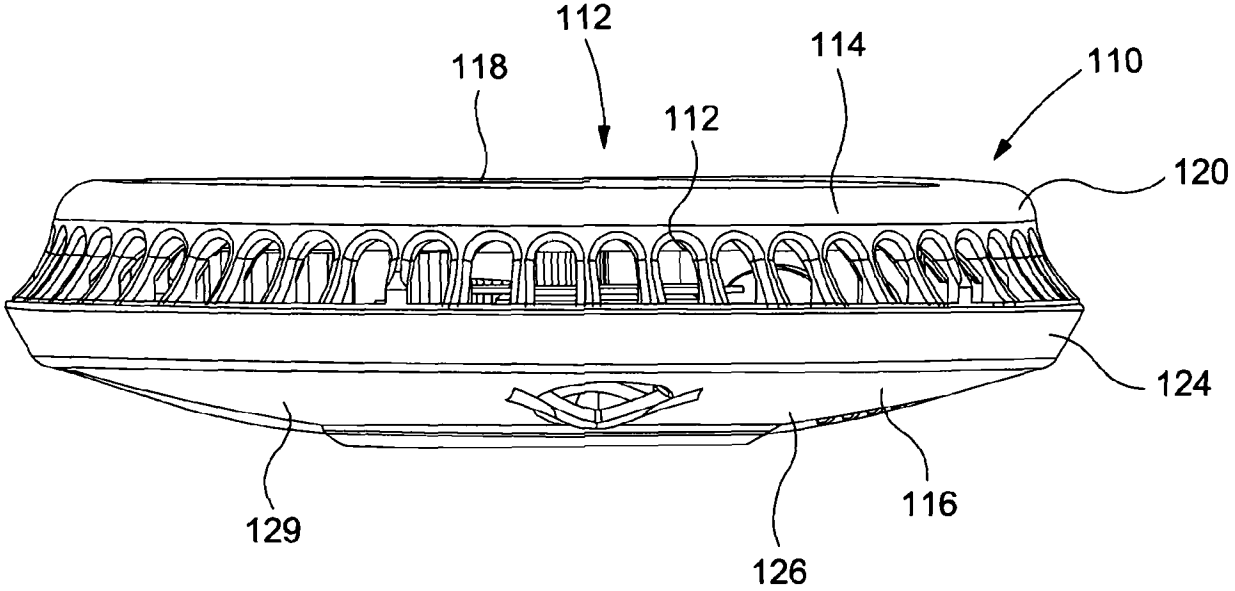
FIG. 2 is a side elevation of the alarm of FIG. 1.
Figure 3:
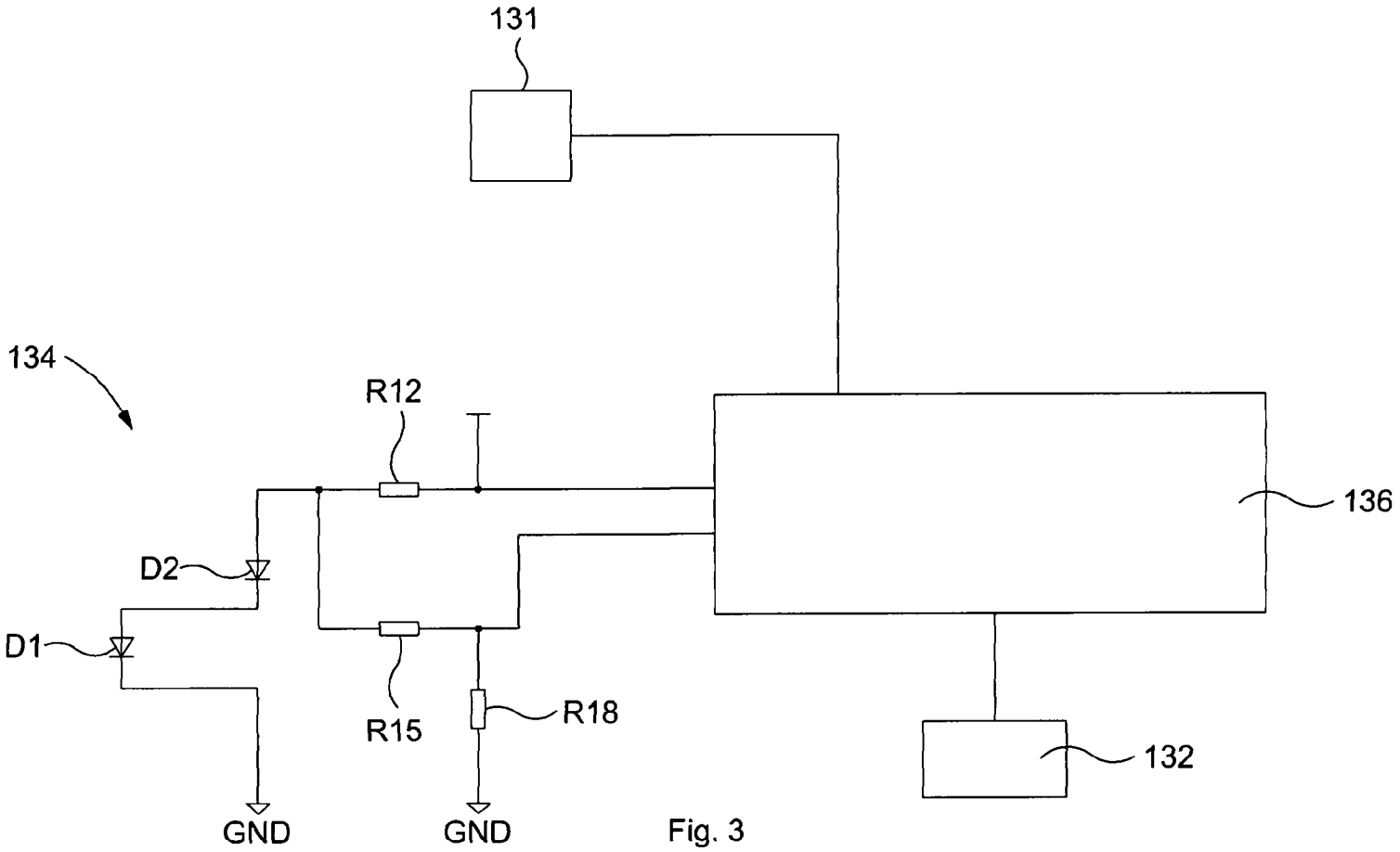
FIG. 3 is a circuit diagram of a portion of a control circuit for the alarm of FIG. 1.

Referring to the drawings these show a preferred form of optical smoke alarm 110 having a housing 112 which has a base 114 and a cover 116. The base enables the alarm to be attached to a surface such as a room ceiling by suitable means. The base has a generally planar bottom wall 118 for abutment with the ceiling or an intervening mounting plate, and a side wall 120. The latter has a plurality of openings 122 arranged along its circumference to allow the ingress of smoke and the like. The cover 116 is generally "cup" or "saucer" shaped having a side wall 124 and a bottom wall 126 defining the interior of the cover. The cover 116 has an internal surface generally (not shown) facing towards the base 114. A boundary of the housing is formed by a major portion of the internal surface or bottom wall. The term "major portion" in this embodiment refers to at least 30% of the bottom wall and preferably at least 50%. The bottom wall 126 also has an external surface 129 which is generally planar without any significant disruptions to the surface, such as a bell housing which has been used in known alarms, to provide a generally aesthetically pleasing shape.

The alarm has an optical sensor 131, and a control circuit 130 preferably contained within the housing between the internal surface 127 and the base 114, the control circuit controlling operation of the detector. The alarm may also contain a sounder 132 for sounding an audible alarm when triggered by the control circuit in response to signals received from the sensor. Alternatively or additionally the sounder may be located remote from the alarm and activated by radio or other wireless signal transmission.

A regular characteristic of fast flaming fires is a rapid rise in temperature within the room containing the fire and the control circuit includes a temperature sensing means 134 for sensing this fast rise in ambient temperature. The temperature sensing in this case is a semiconductor device whose voltage or current varies with temperature. Ideally the semiconductor characteristics vary substantially linearly with temperature over a major portion of the working range.

In the illustrated embodiment the temperature sensing means is two series connected diodes whose forward bias voltage varies with temperature. Two diodes are used for increased sensitivity although one or more than two may be used.

The circuit uses the forward biased voltage change with temperature to detect the rapid rise in temperature and trigger the alarm.

The control circuit 130 has a microprocessor 136 which applies power periodically to resistance R12 in order to provide a bias current through both diodes D1 and D2. The power is applied for a predetermined time period at preselected intervals of time set by the microprocessor, for example the power is, in this example, applied for 4 ms every 10 seconds at the same time that smoke sensing occurs. This generates a voltage drop across the diodes that is measured via R15 and R18 and sampled by the microprocessor 136 at the preselected intervals. The resistors R15, R18 act as a voltage divider and reduce the voltage to an acceptable level for the microprocessor 136, ensuring that the voltage input to the measuring circuit in the microprocessor 136 does not exceed that circuit's specified range.

In the event of a rapid rise in temperature, as would be experienced in a fast flaming fire, the voltage across one or both of the diodes will drop quickly. The voltage and its rate of change is monitored by the microprocessor 136, and any rapid change in voltage is identified by the microprocessor 136 as a potential fire. The microprocessor then, in effect, increases the sensitivity of the optical sensor 131. This is achieved by increasing the gain of the control circuit amplifier which receives the sensor signal to cause generation of an alarm signal earlier than would otherwise be the case. The power applied to the temperature sensing circuit may be from a fixed voltage source or from a time varying voltage source such as a battery. In the latter case, voltage will typically vary very slowly in relation to the build-up of a fire so have little effect on the performance of this circuit.

Figure 4A:
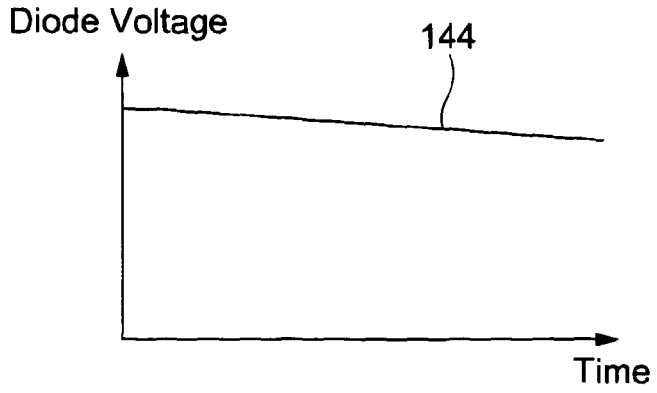
FIGS. 4*a* to 4*d* are graphs illustrating the different responses to slow smouldering and fast flaming fires.
Figure 4B:
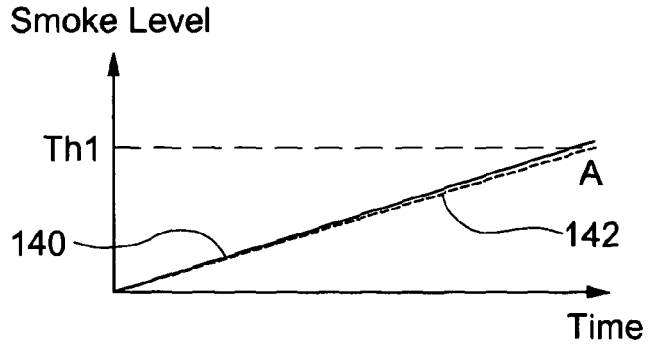
Figure 4C:
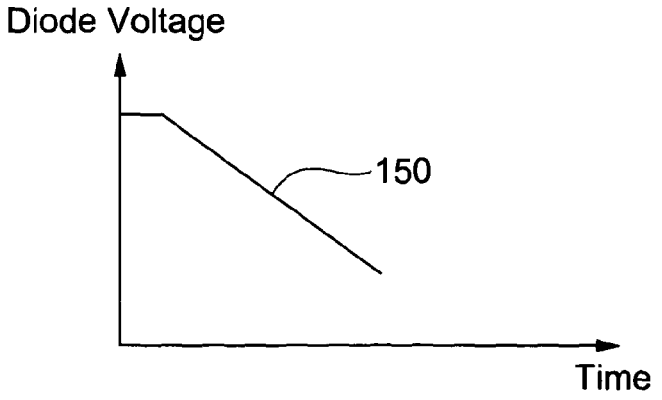
Figure 4D:
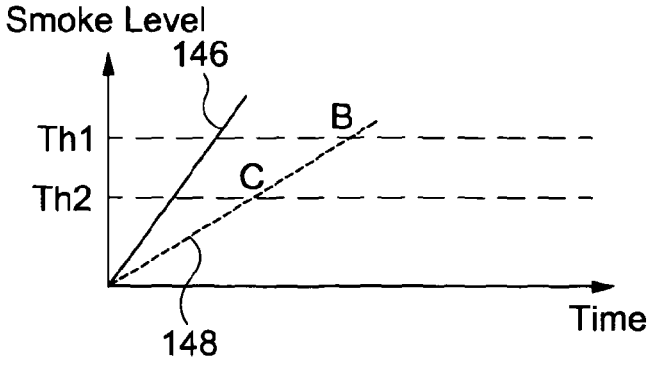
Figure 5:
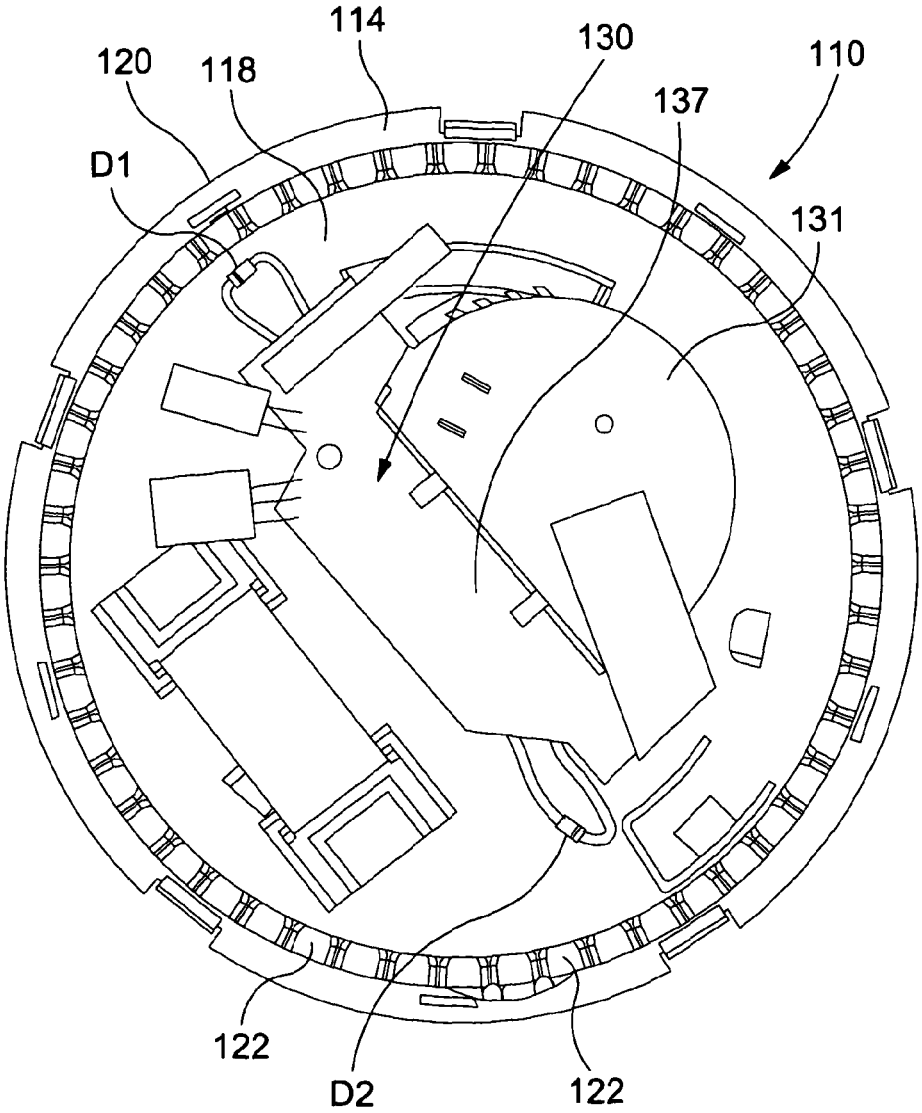
FIG. 5 is a plan view of the alarm of FIG. 1 with the cover removed.
Figure 6:
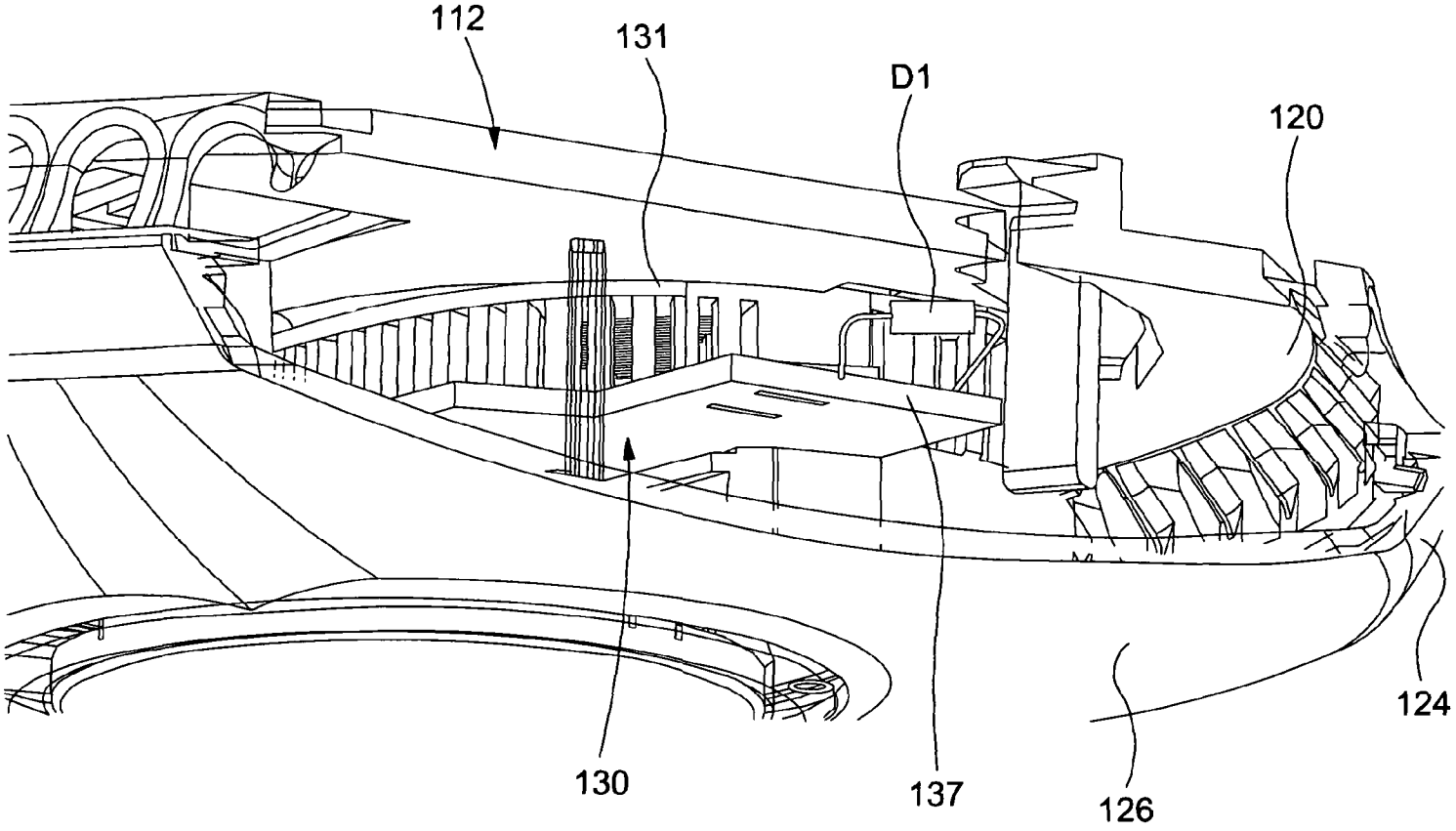
FIG. 6 is a perspective view of a portion of the alarm with the cover removed.

Referring to FIGS. 4*a* to 4*d*, FIG. 4*a* shows the diode voltage response with time for a slow smouldering fire and FIG. 4*b* shows how the smoke level rises with time. FIG. 4*c* shows the diode voltage response with time for a fast flaming fire and FIG. 4*d* shows how the smoke level rises with time in this type of fire.

In the case of a slow smouldering fire, the level of smoke grows relatively slowly with time. The level of visible obscuration is shown in the solid line 140 in FIG. 4*b*. The smoke detector senses reflected light (as do all conventional optical domestic detectors) and the amount of reflected light seen by the detector, shown in the dotted line 142, typically increases at the same rate as the obscuration. As the fire progresses the temperature rises slowly and the forward bias voltage across the diode(s) D1, D2 drops slowly with time as illustrated by the curve 144 in FIG. 4*a*. If the nominal alarm detector threshold for the smoke level is Th1 in FIG. 4*b*, the alarm will trip at point "A" on curve 142, to activate the sounder.

In the case of a fast flaming fire, the smoke level (visible obscuration) climbs rapidly as shown in the solid line 146 in FIG. 4*d*. However, smoke in this type of fire is frequently very dark or black, so the level of reflected light seen by the optical detector of the sensor is relatively much lower for a given level of obscuration, as illustrated by dotted curve 148. In this scenario, if the nominal alarm detector threshold for the smoke level is Th1 in FIG. 4*d* then the conventional optical alarm will not trip until point "B" on curve 148.

However, in the applicant's alarm, as the fire progresses, the temperature increases rapidly in a fast flaming fire, and the forward bias voltage across the diode(s) D1, D2 drops rapidly with time as illustrated by the curve 150 in FIG. 4*c*. In the applicant's smoke detector the rate of diode voltage drop is measured, and if it exceeds a preset value then the possibility of a fast flaming fire is presupposed. The sensitivity of the sensor/control circuit is increased to the value Th2 in FIG. 4*d* and the alarm then triggers at point "C" on curve 148, significantly reducing the time to alarm. As will be appreciated, in this arrangement the optical sensor is the main sensor for the purpose of detecting the fire and raising an alarm in response thereto and the temperature sensors are used to control the sensitivity of the optical sensor.

Ideally, the microcontroller 136 samples the change in voltage a preselected number of times or over a preselected number of periods before generating an alarm signal to ensure that it is not spurious.

As will be appreciated, the control circuit does not measure absolute temperature, only a change in temperature as indicated by a change in diode voltages.

At least two diodes are used and are positioned at different locations in the alarm housing to allow for the possibility that one diode may be in a sheltered position relative to the flow of hot air from the fire through the housing openings 122, for example if the fire is only on one side of the alarm a single sensor may be in a position in which it is shielded by the alarm circuitry and would hence have a slower reaction to the increase in temperature. As can be seen the diodes are substantially equally spaced around the alarm and although two are shown approximately at 180° to one another it will be appreciated that more than two sensors could be used. The diodes are located between the internal surface of the bottom wall 126 and the base 114 and ideally between the boundary of the housing and the base 114.

The diodes are located in the housing in the path of the hot air and preferably on a level with the openings 122 so that they are in the direct path of hot air and smoke passing through the housing 112. Ideally the diodes are situated on a printed circuit board 137 of the control circuit 130.

The above described optical smoke alarm detects the rapid change in heat in a fast flaming fire and significantly reduces the time to alarm after the fire starts and close to the time to alarm for ionisation type alarms. This time can be reduced to below the range of 180 to 240 seconds.

Although the terms diode and diodes are used in the description of the embodiment it will be appreciated by those skilled in the art that any suitable temperature sensing means may be used wherever the description refers to a diode or diodes.

The invention claimed is:

1. An optical smoke detector comprising:

a housing having a base configured for attaching said detector to a surface, and a cover having a side wall and a bottom wall defining an interior of said cover;

an optical sensor for generating a signal representative of detected light;

and a control circuit for controlling operation of the detector;

wherein:

said control circuit includes a plurality of temperature sensors for sensing a rise in ambient temperature caused by a fire and generating a signal representative thereof, and wherein said control circuit is configured to adjust the sensitivity of the optical sensor in dependence on a comparison of said representative signal from the temperature sensors with a reference value and in dependence on a comparison of voltage and rate of change of voltage of said representative signal from the temperature sensors to change the threshold at which smoke is detected;

said temperature sensors are located above an internal surface of said bottom wall within the housing and are substantially equally spaced;

and said control circuit is configured to compare said signal representative of detected light with a reference signal and generate an alarm signal in dependence thereon.

2. A smoke detector according to claim 1 wherein the reference signal is a predetermined signal level stored in the control circuit.

3. An optical smoke detector comprising:

a housing having a base configured for attaching said detector to a surface, and a cover having a side wall and a bottom wall defining an interior of said cover;

an optical sensor for generating a signal representative of detected light;

and a control circuit for controlling operation of the detector;

wherein:

said control circuit includes a plurality of temperature sensors for sensing a rise in ambient temperature caused by a fire and generating a signal representative thereof, and wherein said control circuit is configured to adjust the sensitivity of the optical sensor in dependence on a comparison of said representative signal from the temperature sensors with a reference value and in dependence on a comparison of voltage and rate of change of voltage of said representative signal from the temperature sensors to change the threshold at which smoke is detected;

said temperature sensors are located above an internal surface of said bottom wall within the housing and are substantially equally spaced; and said control circuit is configured to compare said signal representative of detected light with a reference signal and generate an alarm signal in dependence thereon;

wherein comparing said signal with a reference signal representative of detected light and generating an alarm signal in dependence thereon further comprises the control circuit being configured to receive a signal from the optical sensor, compare the received signal from the optical sensor to an optical signal threshold and to only generate an alarm signal if the signal from the optical sensor exceeds said threshold.

4. A smoke detector according to claim 1 wherein adjusting the sensitivity of the optical sensor comprises lowering the threshold at which smoke is detected.

5. A smoke detector according to claim 1 wherein the temperature sensors are fully enclosed within the smoke detector housing between the base and the cover.

6. A smoke detector according to claim 1 wherein said temperature sensors are located above a boundary formed by a major portion of said bottom wall.

7. A smoke detector according to claim 1 wherein:

said base has a side wall with a plurality of openings for the ingress of hot air and smoke;

and said temperature sensors are located in the path of said hot air passing through said openings.

8. A smoke detector as claimed in claim 7 wherein:

said temperature sensors are located substantially on the same level as said openings.

9. A smoke detector according to claim 1 wherein said temperature sensors are a devices having an electrical property which changes with temperature change.

10. A smoke detector as claimed in claim 9 wherein said temperature sensors are semiconductor devices having a voltage or current characteristic which varies with temperature.

11. A smoke detector as claimed in claim 10 wherein said characteristic varies substantially linearly with temperature over a major portion of its range.

12. A smoke detector according to claim 1 wherein said temperature sensors are diodes whose forward bias voltage varies with temperature.

13. A smoke detector according to claim 1 wherein said temperature sensors are at least two series connected diodes whose forward bias voltage varies with temperature.

14. A smoke detector according to claim 1 wherein said cover is substantially cup shaped.

15. A smoke detector according to claim 1 wherein said cover is substantially saucer shaped.

16. A smoke detector according to claim 4 wherein the threshold at which smoke is detected is lowered if said temperature sensors detect an increase in temperature above a present value.

17. A smoke detector according to claim 12 wherein the sensitivity of the optical sensor is lowered if the diodes detect a voltage drop that exceeds a present value.

* * * * *